US010288082B2

(12) United States Patent
Howe

(10) Patent No.: US 10,288,082 B2
(45) Date of Patent: May 14, 2019

(54) CENTRIFUGAL FAN ASSEMBLY INCLUDING COOLING VANES AND A COOLING PLATE

(71) Applicant: Carnes Company, Inc., Pewaukee, WI (US)

(72) Inventor: Nicholas B. Howe, Madison, WI (US)

(73) Assignee: Carnes Company, Inc., Pewaukee, WI (US)

( * ) Notice: Subject to any disclaimer, the term of this patent is extended or adjusted under 35 U.S.C. 154(b) by 150 days.

(21) Appl. No.: 15/351,929

(22) Filed: Nov. 15, 2016

(65) Prior Publication Data

US 2018/0135651 A1 May 17, 2018

(51) Int. Cl.

| | |
|---|---|
| ***F04D 17/08*** | (2006.01) |
| ***F04D 25/08*** | (2006.01) |
| ***F04D 29/42*** | (2006.01) |
| ***F04D 29/44*** | (2006.01) |
| ***F04D 29/58*** | (2006.01) |
| ***F04D 29/28*** | (2006.01) |
| ***F04D 17/16*** | (2006.01) |
| ***F04D 29/62*** | (2006.01) |

(52) U.S. Cl.

CPC ..... *F04D 29/283* (2013.01); *F04D 17/08* (2013.01); *F04D 17/16* (2013.01); *F04D 25/082* (2013.01); *F04D 29/4226* (2013.01); *F04D 29/441* (2013.01); *F04D 29/5806* (2013.01); *F04D 29/626* (2013.01); *F04D 29/281* (2013.01)

(58) Field of Classification Search

CPC ..... F04D 29/5806; F04D 17/08; F04D 17/10; F04D 25/082; F04D 25/16; F04D 29/002; F04D 29/185; F04D 29/2238; F04D 29/283; F04D 29/2211; F04D 29/225; F04D 29/424; F04D 29/4233; F04D 17/105

See application file for complete search history.

(56) References Cited

U.S. PATENT DOCUMENTS 2,260,042 A * 10/1941 McMahan ..... F04D 25/0606 310/58

2,666,378 A 1/1954 Ammerman (Continued)

FOREIGN PATENT DOCUMENTS

| | | |
|---|---|---|
| EP | 0641972 | 3/1995 |
| WO | 2014009688 | 1/2014 |

*Primary Examiner* — Bryan M Lettman
*Assistant Examiner* — Timothy P Solak
(74) *Attorney, Agent, or Firm* — Michael Best & Friedrich LLP

(57) ABSTRACT

A fan assembly includes a drive housing having a shaft opening, a drive mechanism (e.g., an electric motor) positioned in the drive housing and including a fan shaft positioned through the shaft opening, and a fan rotor mounted for rotation with the fan shaft. The fan rotor includes cooling vanes and a cooling plate positioned between the cooling vanes and the shaft opening. Preferably, the cooling plate includes a flat portion adjacent the cooling vanes and a substantially curved portion radially inward of the flat portion to guide air from the drive housing to the cooling vanes. The fan rotor can further include exhaust blades and a back plate between the exhaust blades and the cooling vanes. An air inlet shroud guides air to the exhaust blades, and the fan rotor can further include an inlet venturi plate positioned between the exhaust blades and the air inlet shroud.

9 Claims, 7 Drawing Sheets

(56) References Cited

U.S. PATENT DOCUMENTS

| | | | | | |
|---|---|---|---|---|---|
| 2,684,621 | A | | 7/1954 | Cook | |
| 2,987,983 | A | | 6/1961 | Solzman | |
| 3,045,579 | A | | 7/1962 | Jenn et al. | |
| 3,069,071 | A | * | 12/1962 | Carlson | F04D 17/165 415/116 |
| 3,117,770 | A | * | 1/1964 | Campbell | F04D 17/165 126/110 C |
| 3,202,080 | A | | 8/1965 | Cook | |
| 3,202,081 | A | | 8/1965 | Cook | |
| 3,303,995 | A | | 2/1967 | Boeckel | |
| 3,330,379 | A | | 7/1967 | Cook | |
| 3,412,670 | A | | 11/1968 | Jenn et al. | |
| 4,200,035 | A | | 4/1980 | Zaniewski | |
| 4,245,965 | A | | 1/1981 | Brown | |
| 4,344,370 | A | * | 8/1982 | Smith | F23L 17/005 110/162 |
| 4,436,484 | A | * | 3/1984 | Temple | F04D 29/283 416/178 |
| 4,759,272 | A | | 7/1988 | Zaniewski | |
| 4,890,547 | A | | 1/1990 | Wagner et al. | |
| 4,902,199 | A | * | 2/1990 | McDonald | F04D 25/16 415/143 |
| 5,669,811 | A | | 9/1997 | Zaniewski | |
| 5,879,232 | A | | 3/1999 | Luter, II et al. | |
| 5,938,527 | A | | 8/1999 | Oshima et al. | |
| 6,289,555 | B1 | | 9/2001 | Nguyen et al. | |
| 6,454,247 | B2 | | 9/2002 | Ujvari | |
| 7,320,636 | B2 | * | 1/2008 | Seliger | B08B 15/002 126/299 F |
| RE43,653 | E | | 9/2012 | Lin | |
| 2004/0072538 | A1 | | 4/2004 | Kennedy et al. | |
| 2004/0231090 | A1 | * | 11/2004 | Kushida | A47L 5/22 15/326 |

* cited by examiner

CENTRIFUGAL FAN ASSEMBLY INCLUDING COOLING VANES AND A COOLING PLATE

BACKGROUND

The present invention relates to fans for ventilation and specifically to centrifugal fan assemblies.

Centrifugal fan assemblies are commonly used to ventilate spaces, such as buildings or large equipment. Such assemblies, often called ventilators, typically include a housing, a drive system (typically including an electric motor) supported by the housing, and a fan rotor driven by the drive system. It is known to have a fan rotor with two sets of vanes, one for moving air out of the building or space, commonly called blades, and another for moving air over the drive system for cooling.

SUMMARY

The present invention provides a fan assembly that enhances the cooling of any component making up the drive system (e.g., a motor, bearings, belts, electronics, etc.). The fan assembly comprises a drive system housing having a shaft opening, a drive mechanism (e.g., an electric motor) positioned in the housing and including a fan shaft positioned through the shaft opening, and a fan rotor mounted for rotation with the fan shaft. The fan rotor includes cooling vanes and a cooling plate positioned between the cooling vanes and the shaft opening. Preferably, the cooling plate includes a substantially flat portion adjacent the cooling vanes and a substantially curved portion radially inward of the substantially flat portion to guide air from the motor housing to the cooling vanes.

In one embodiment, the fan rotor further includes exhaust blades and a back plate between the exhaust blades and the cooling vanes. The cooling plate includes a curved inlet section to more efficiently draw air from the drive system housing. Preferably, the cooling plate and the back plate have outer diameters that are substantially the same. The fan assembly can further include a main housing having an air inlet shroud guiding air to the exhaust blades, and the fan rotor can further include an inlet venturi plate positioned between the exhaust blades and the air inlet shroud. Preferably, the inlet venturi plate has an outer diameter that is substantially the same as the outer diameters of cooling plate and the back plate To secure the back plate to the cooling vane, the back plate includes a series of angle slots, and an end of each cooling vane is positioned in a corresponding angled slot in the back plate. To secure the cooling plate to the cooling vanes, the cooling plate includes a series of recesses, and the cooling vanes each include a mounting boss positioned in a corresponding recess in the cooling plate.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
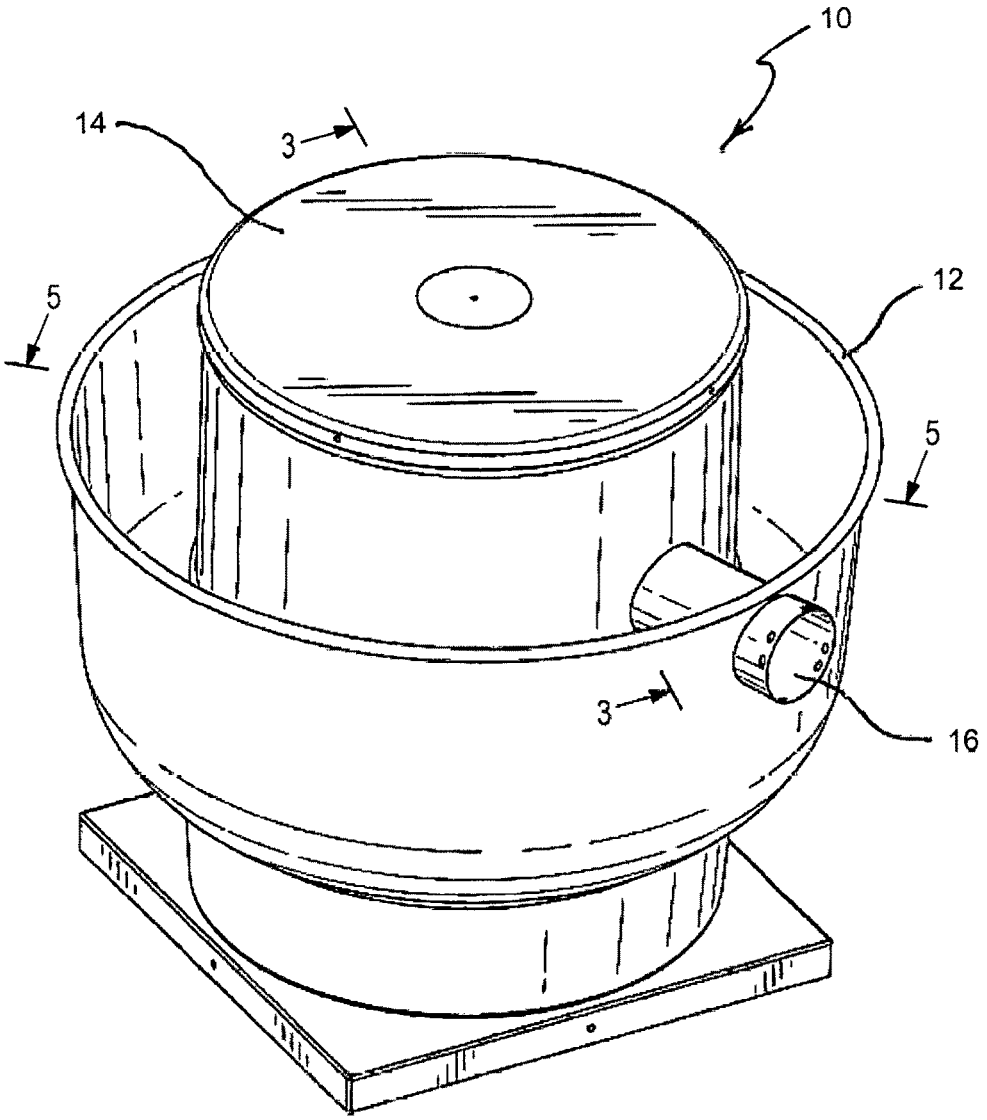
FIG. 1 is a perspective view of a fan assembly embodying the present invention.
Figure 2:
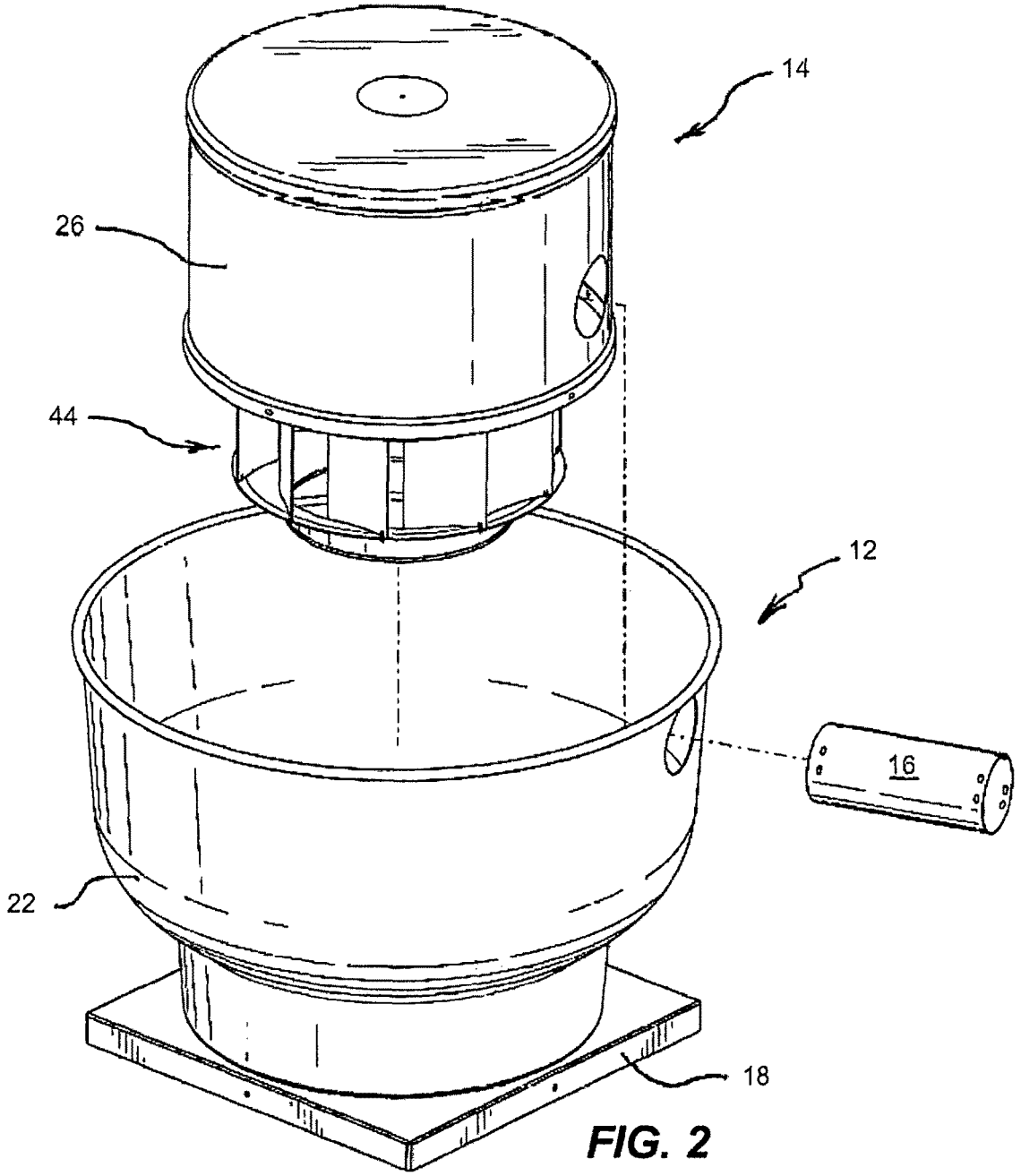
FIG. 2 is a partially exploded view of the fan assembly of FIG. 1.

FIG. 1 illustrates a fan assembly 10 having a main housing 12, a drive/rotor assembly 14 mounted in the main housing 12, and a cooling tube 16 for providing cooling air to the inside of the drive/rotor assembly 14.

The main housing 12 includes a base 18 for mounting to a structure, such as a roof of a building. An air inlet shroud 20 guides air into the fan assembly 10, and an air outlet shroud 22 guides air out of the fan assembly 10.

Figure 4:
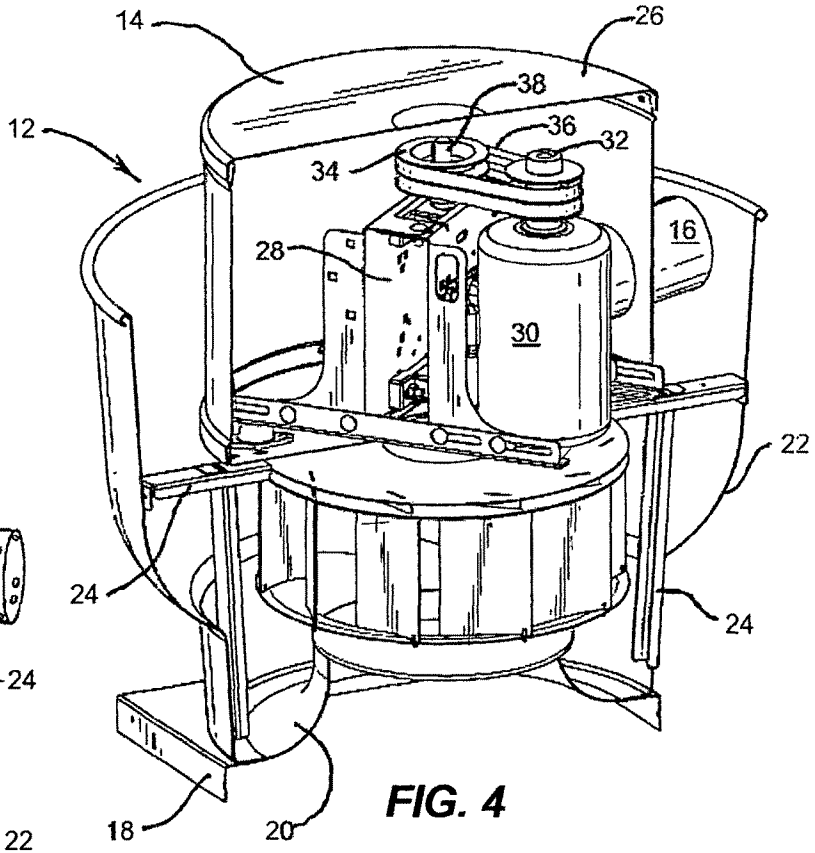
FIG. 4 is perspective view of the fan assembly of FIG. 3 from a different angle.
Figure 3:
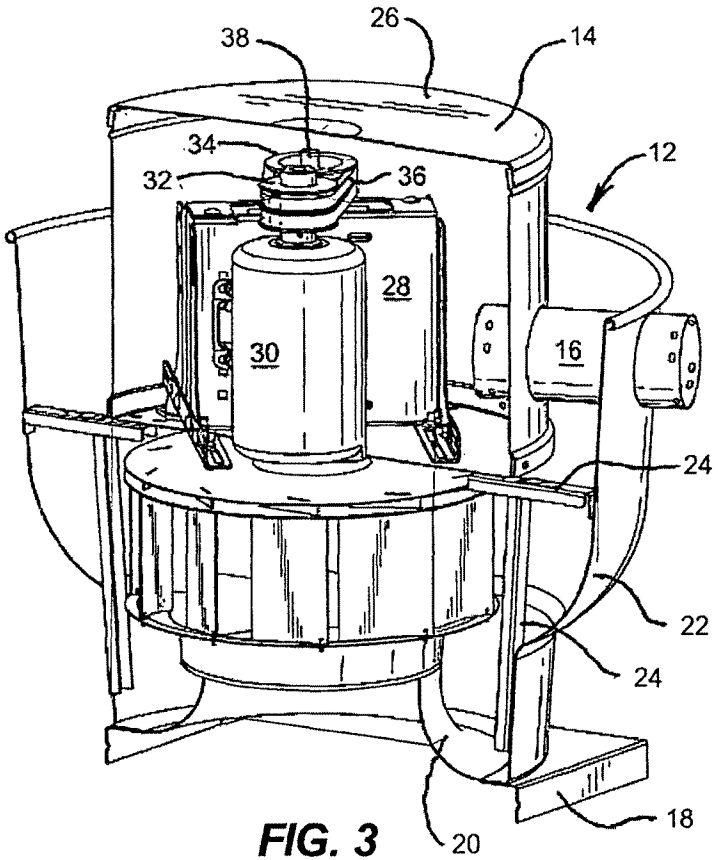
FIG. 3 is a perspective view of the fan assembly of FIG. 1 in partial section.
Figure 5:
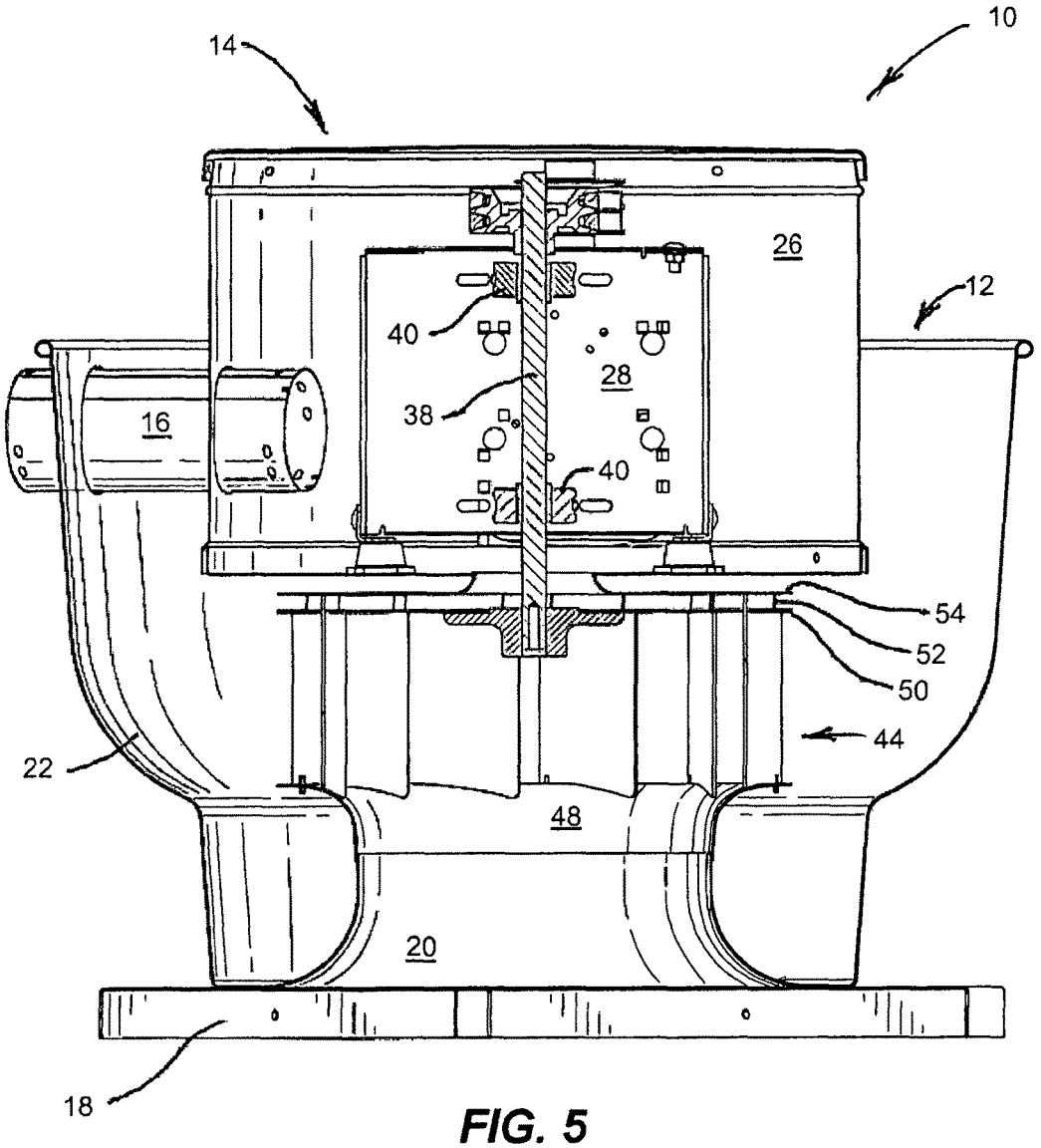
FIG. 5 is a side section view taken along line 5-5 in FIG. 1.

The drive/rotor assembly 14 is mounted partially inside the main housing 12 by a series of brackets 24 (see FIGS. 3-4). The drive/rotor assembly 14 includes a drive housing 26, a support structure 28 mounted inside the drive housing 26, and a drive mechanism mounted to one of the support plates 28. The illustrated drive mechanism includes an electric motor 30 that drives a drive pulley 32 to provide power to a driven pulley 34 via a drive belt 36. The driven pulley 34 drives a fan shaft 38 that is supported by bearings 40 secured to the other support plate 28. The fan shaft 38 projects through a shaft opening 42 in the end of the motor housing 26. It should be understood that other drive mechanisms, such as combustion engines or direct drive arrangements, can be used.

The drive/rotor assembly 14 further includes a fan rotor 44 secured to a lower end of the fan shaft 38. The fan rotor 44 includes a series of exhaust blades 46 sandwiched between an inlet venturi plate 48 and a back plate 50. The inlet venturi plate 48 includes a substantially flat outer portion 49 and a curved inner portion 51. The exhaust blades 46 are oriented to pull air from the air inlet shroud 20, through the inlet venturi plate 48 and push the air through the air outlet shroud 22 when the motor 30 is turning the fan shaft 38, as is generally known in the art.

Figure 6:
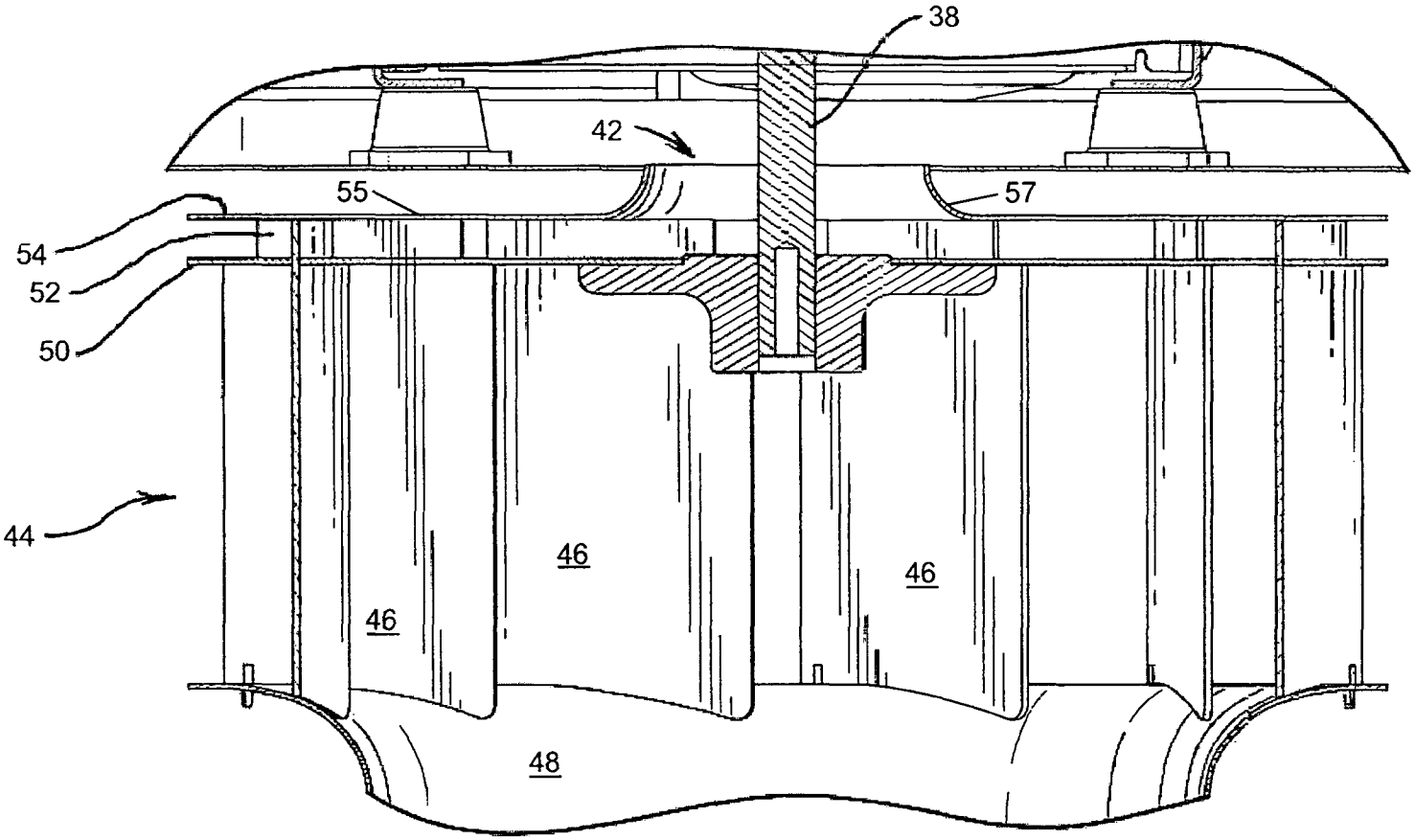
FIG. 6 is an enlarged view of the fan assembly of FIG. 5.

The fan rotor 44 further includes a series of cooling vanes 52 sandwiched between the back plate 50 and a cooling plate 54. As best shown in FIG. 6, the cooling plate 54 includes a substantially flat outer portion 55 and a curved inner portion 57. The cooling vanes 52 are oriented to pull air through the cooling tube 16, motor housing 26 and cooling plate 54 and push the air through the air outlet shroud 22. In the illustrated embodiment, the inlet venturi plate 48, the back plate 50, and the cooling plate 54 all have substantially the same outer diameter.

Figure 7:
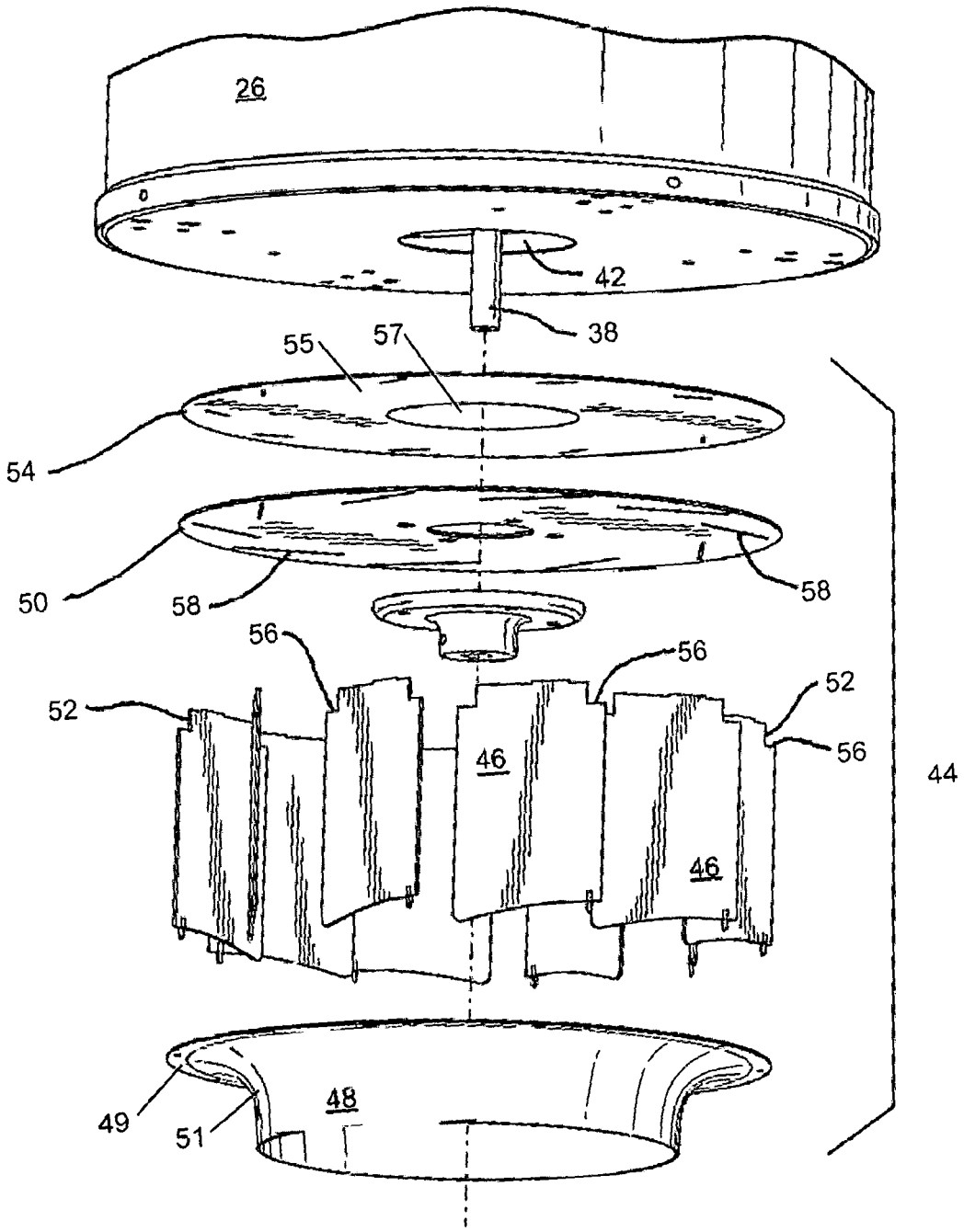
FIG. 7 is an exploded view of the fan assembly.
Figure 8:
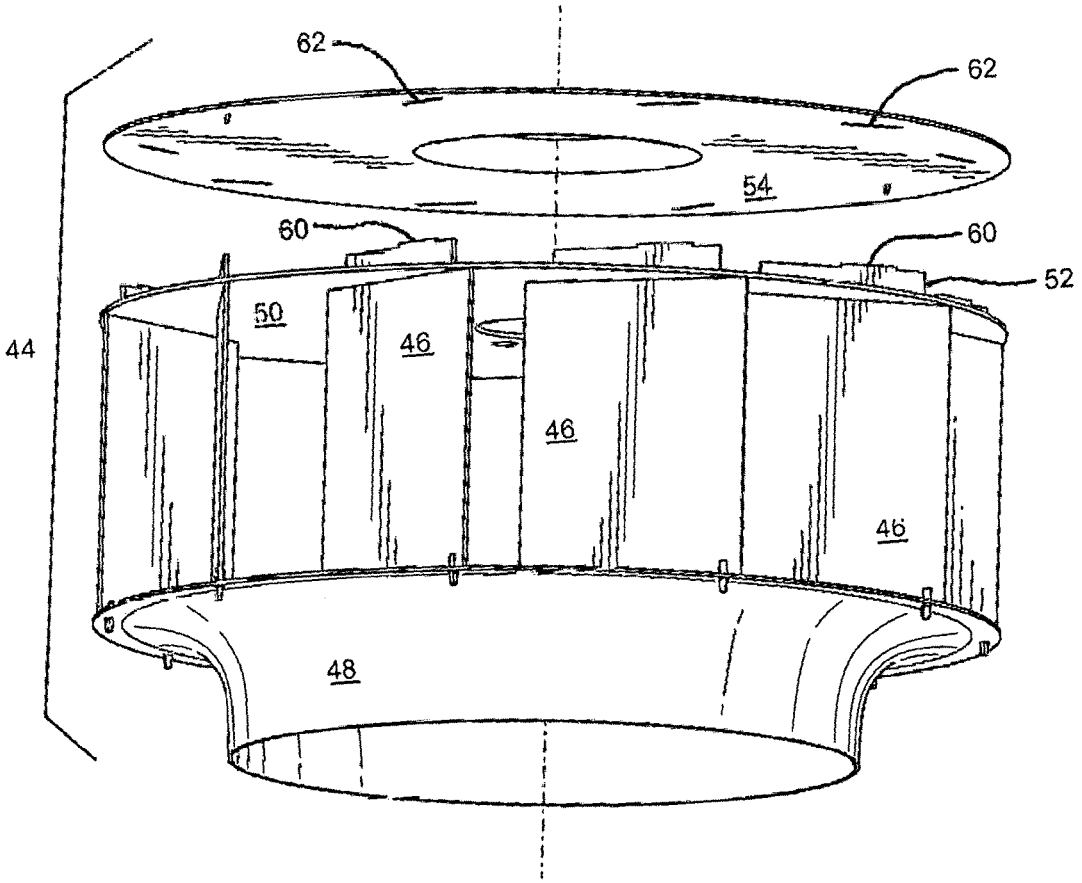
FIG. 8 is a mostly assembled view of the fan assembly.

In the illustrated embodiment, each cooling vane 52 is formed integrally with a corresponding exhaust vane 46 with a pair of shoulders 56 (FIG. 7) defining the boundary in between. The back plate 50 includes a series of angled slots 58 (FIG. 7) that slide over the cooling vanes 52 to seat against the shoulders 56. Each cooling vane 52 further includes a mounting boss 60 (FIG. 8) that is adapted to fit within a corresponding recess 62 in the cooling plate 54 to thereby position the cooling plate 54 in spaced relation to the back plate 50.

In operation, as the motor 30 turns the fan rotor 44, the cooling vanes 52 draw air in through the cooling tube 16, drive housing 26, shaft opening 42 and cooling plate 54. Air from the cooling vanes 52 is then forced out the outlet shroud 22. The presence of the cooling plate 54 enhances the volume and efficiency of the airflow.

In order to test the new feature, a ventilator was tested with and without the cooling plate, and temperatures were recorded at four locations on the windings of the electric motor in the ventilator (Winding 1, Winding 2, Winding 3, Winding 4) at one-minute intervals for fifty-three minutes. Ambient temperature was also recorded for each data point. Prior to taking measurements, the drive system was operated until steady state operating temperatures were achieved. The differences between the steady state temperatures of the coils and the ambient temperatures, with and without the cooling plate, were then determined, and an average temperature rise was calculated to determine the effectiveness of the cooling plate invention. The raw data is shown in Table 1 and Table 2 below.

TABLE 1

Ventilator with Cooling Plate
All Measurements in Degrees F.

| Det. | Winding 1 | Winding 2 | Winding 3 | Winding 4 | Ambient | W1 Rise | W2 Rise | W3 Rise | W4 Rise |
|---|---|---|---|---|---|---|---|---|---|
| 1 | 121.6 | 112.5 | 114.6 | 118.1 | 72.4 | 49.2 | 40.1 | 42.2 | 45.7 |
| 2 | 122.3 | 113.1 | 115.4 | 118.8 | 72.5 | 49.8 | 40.6 | 42.9 | 46.4 |
| 3 | 123.0 | 113.6 | 115.9 | 119.4 | 72.5 | 50.5 | 41.1 | 43.5 | 46.9 |
| 4 | 126.2 | 116.4 | 118.9 | 122.5 | 72.5 | 53.7 | 43.9 | 46.4 | 50.0 |
| 5 | 126.8 | 116.8 | 119.4 | 123.0 | 72.5 | 54.3 | 44.3 | 46.9 | 50.5 |
| 6 | 127.3 | 117.2 | 119.9 | 123.5 | 72.5 | 54.8 | 44.7 | 47.4 | 51.0 |
| 7 | 129.8 | 119.3 | 122.1 | 125.8 | 72.6 | 57.2 | 46.7 | 49.5 | 53.2 |
| 8 | 130.2 | 119.6 | 122.3 | 126.2 | 72.6 | 57.6 | 47.0 | 49.7 | 53.6 |
| 9 | 130.6 | 120.0 | 122.9 | 126.6 | 72.6 | 58.0 | 47.4 | 50.2 | 53.9 |
| 10 | 132.5 | 121.6 | 124.5 | 128.3 | 72.7 | 59.9 | 48.9 | 51.9 | 55.7 |
| 11 | 132.9 | 121.9 | 124.7 | 128.7 | 72.7 | 60.2 | 49.2 | 52.0 | 56.0 |
| 12 | 133.2 | 122.1 | 125.2 | 128.9 | 72.7 | 60.6 | 49.5 | 52.5 | 56.3 |
| 13 | 134.6 | 123.3 | 126.5 | 130.3 | 72.6 | 62.1 | 50.7 | 53.9 | 57.8 |
| 14 | 134.9 | 123.5 | 126.4 | 130.5 | 72.7 | 62.1 | 50.8 | 53.7 | 57.8 |
| 15 | 135.1 | 123.7 | 126.9 | 130.7 | 72.6 | 62.5 | 51.1 | 54.3 | 58.1 |
| 16 | 136.2 | 124.5 | 127.7 | 131.7 | 72.7 | 63.5 | 51.8 | 55.1 | 59.0 |
| 17 | 136.4 | 124.8 | 127.9 | 131.9 | 72.6 | 63.7 | 52.1 | 55.3 | 59.3 |
| 18 | 136.6 | 124.9 | 128.2 | 132.1 | 72.6 | 63.9 | 52.2 | 55.5 | 59.5 |
| 19 | 137.3 | 125.5 | 128.9 | 132.8 | 72.8 | 64.6 | 52.8 | 56.1 | 60.1 |
| 20 | 137.5 | 125.6 | 128.8 | 132.9 | 72.8 | 64.7 | 52.8 | 56.1 | 60.2 |
| 21 | 138.2 | 126.2 | 129.4 | 133.6 | 72.9 | 65.3 | 53.3 | 56.6 | 60.7 |
| 22 | 138.2 | 126.2 | 129.7 | 133.6 | 72.8 | 65.4 | 53.3 | 56.8 | 60.8 |
| 23 | 138.3 | 126.3 | 129.7 | 133.7 | 72.9 | 65.4 | 53.4 | 56.8 | 60.9 |
| 24 | 138.8 | 126.7 | 130.0 | 134.1 | 72.9 | 65.9 | 53.8 | 57.1 | 61.2 |
| 25 | 138.8 | 126.7 | 130.0 | 134.2 | 73.0 | 65.9 | 53.8 | 57.1 | 61.2 |
| 26 | 139.2 | 127.0 | 130.5 | 134.5 | 72.9 | 66.4 | 54.2 | 57.6 | 61.6 |
| 27 | 139.3 | 127.1 | 130.6 | 134.6 | 72.9 | 66.4 | 54.2 | 57.7 | 61.7 |
| 28 | 139.3 | 127.1 | 130.6 | 134.6 | 72.9 | 66.4 | 54.2 | 57.7 | 61.6 |
| 29 | 139.6 | 127.4 | 130.9 | 134.9 | 72.9 | 66.7 | 54.5 | 57.9 | 61.9 |
| 30 | 139.6 | 127.4 | 130.8 | 134.9 | 73.0 | 66.6 | 54.4 | 57.8 | 61.9 |
| 31 | 139.6 | 127.4 | 131.0 | 134.9 | 73.0 | 66.7 | 54.5 | 58.0 | 62.0 |
| 32 | 139.8 | 127.6 | 130.9 | 135.1 | 73.0 | 66.8 | 54.6 | 57.9 | 62.1 |
| 33 | 139.9 | 127.6 | 131.0 | 135.1 | 73.1 | 66.8 | 54.5 | 57.9 | 62.1 |
| 34 | 139.9 | 127.6 | 131.1 | 135.2 | 73.0 | 66.9 | 54.7 | 58.1 | 62.2 |
| 35 | 140.0 | 127.8 | 131.2 | 135.3 | 73.0 | 67.0 | 54.8 | 58.1 | 62.3 |
| 36 | 140.1 | 127.8 | 131.2 | 135.3 | 73.0 | 67.1 | 54.8 | 58.2 | 62.3 |
| 37 | 140.1 | 127.8 | 131.0 | 135.4 | 72.9 | 67.2 | 54.8 | 58.1 | 62.4 |
| 38 | 140.2 | 127.9 | 131.6 | 135.5 | 73.4 | 66.9 | 54.6 | 58.3 | 62.2 |
| 39 | 140.3 | 127.9 | 131.5 | 135.5 | 73.2 | 67.1 | 54.7 | 58.3 | 62.3 |
| 40 | 140.3 | 127.9 | 131.3 | 135.5 | 73.2 | 67.1 | 54.8 | 58.1 | 62.3 |
| 41 | 140.4 | 128.1 | 131.5 | 135.6 | 73.1 | 67.3 | 55.0 | 58.4 | 62.5 |
| 42 | 140.5 | 128.0 | 131.5 | 135.7 | 73.0 | 67.5 | 55.0 | 58.5 | 62.7 |
| 43 | 140.5 | 128.1 | 131.8 | 135.7 | 73.1 | 67.4 | 55.0 | 58.7 | 62.6 |
| 44 | 140.5 | 128.1 | 131.6 | 135.8 | 73.0 | 67.5 | 55.0 | 58.6 | 62.7 |
| 45 | 140.6 | 128.1 | 131.8 | 135.8 | 73.1 | 67.5 | 55.1 | 58.8 | 62.7 |
| 46 | 140.6 | 128.2 | 131.7 | 135.8 | 73.1 | 67.6 | 55.1 | 58.6 | 62.7 |
| 47 | 140.6 | 128.2 | 131.7 | 135.9 | 73.0 | 67.6 | 55.1 | 58.7 | 62.8 |
| 48 | 140.6 | 128.2 | 131.8 | 135.8 | 73.0 | 67.6 | 55.2 | 58.7 | 62.8 |
| 49 | 140.7 | 128.1 | 131.7 | 135.8 | 73.1 | 67.6 | 55.1 | 58.6 | 62.7 |
| 50 | 140.6 | 128.2 | 131.7 | 135.9 | 73.0 | 67.6 | 55.2 | 58.7 | 62.8 |
| 51 | 140.6 | 128.1 | 131.8 | 135.8 | 72.9 | 67.6 | 55.2 | 58.9 | 62.8 |
| 52 | 140.6 | 128.1 | 131.8 | 135.8 | 73.0 | 67.7 | 55.1 | 58.8 | 62.8 |
| 53 | 140.6 | 128.1 | 131.7 | 135.8 | 73.0 | 67.6 | 55.2 | 58.8 | 62.8 |

TABLE 2

| Ventilator without Cooling Plate All Measurements in Degrees F. | | | | | | | | | |
|---|---|---|---|---|---|---|---|---|---|
| Det. | Winding 1 | Winding 2 | Winding 3 | Winding 4 | Ambient | W1 Rise | W2 Rise | W3 Rise | W4 Rise |
| 1 | 137.1 | 125.6 | 127.4 | 133.2 | 71.8 | 65.2 | 53.8 | 55.6 | 61.4 |
| 2 | 137.5 | 126.0 | 127.8 | 133.6 | 71.8 | 65.7 | 54.2 | 55.9 | 61.8 |
| 3 | 139.8 | 127.9 | 129.9 | 135.7 | 71.8 | 67.9 | 56.1 | 58.1 | 63.9 |
| 4 | 140.2 | 128.3 | 130.3 | 136.1 | 71.8 | 68.3 | 56.4 | 58.4 | 64.2 |
| 5 | 140.5 | 128.6 | 130.6 | 136.5 | 71.9 | 68.6 | 56.7 | 58.7 | 64.6 |
| 6 | 142.2 | 130.1 | 132.2 | 138.0 | 71.9 | 70.4 | 58.3 | 60.3 | 66.2 |
| 7 | 142.5 | 130.3 | 132.3 | 138.4 | 71.8 | 70.7 | 58.5 | 60.5 | 66.5 |
| 8 | 142.8 | 130.6 | 132.6 | 138.6 | 71.9 | 70.9 | 58.8 | 60.8 | 66.8 |
| 9 | 144.2 | 131.7 | 133.8 | 139.9 | 71.9 | 72.3 | 59.8 | 61.9 | 68.0 |
| 10 | 144.4 | 131.9 | 134.0 | 140.1 | 71.9 | 72.6 | 60.0 | 62.1 | 68.2 |
| 11 | 144.7 | 132.1 | 134.2 | 140.4 | 71.9 | 72.8 | 60.1 | 62.3 | 68.4 |
| 12 | 145.7 | 133.0 | 135.3 | 141.3 | 71.9 | 73.8 | 61.1 | 63.4 | 69.4 |
| 13 | 145.8 | 133.2 | 135.4 | 141.5 | 71.9 | 73.9 | 61.3 | 63.5 | 69.6 |
| 14 | 146.0 | 133.3 | 135.5 | 141.7 | 71.9 | 74.1 | 61.3 | 63.5 | 69.7 |
| 15 | 146.9 | 133.9 | 136.1 | 142.4 | 72.0 | 74.9 | 62.0 | 64.2 | 70.5 |
| 16 | 147.0 | 134.1 | 136.4 | 142.6 | 72.0 | 75.0 | 62.1 | 64.4 | 70.6 |
| 17 | 147.6 | 134.6 | 136.9 | 143.2 | 72.1 | 75.6 | 62.5 | 64.8 | 71.1 |
| 18 | 147.8 | 134.7 | 137.0 | 143.4 | 72.1 | 75.7 | 62.7 | 65.0 | 71.3 |
| 19 | 147.9 | 134.9 | 137.1 | 143.4 | 72.1 | 75.8 | 62.8 | 65.0 | 71.4 |
| 20 | 148.3 | 135.3 | 137.6 | 143.9 | 72.0 | 76.3 | 63.3 | 65.6 | 71.8 |
| 21 | 148.4 | 135.3 | 137.6 | 144.0 | 72.0 | 76.4 | 63.2 | 65.6 | 71.9 |
| 22 | 148.7 | 135.6 | 138.0 | 144.3 | 72.1 | 76.7 | 63.5 | 65.9 | 72.2 |
| 23 | 148.8 | 135.6 | 138.0 | 144.4 | 72.1 | 76.7 | 63.6 | 65.9 | 72.3 |
| 24 | 148.9 | 135.7 | 138.0 | 144.4 | 72.1 | 76.8 | 63.6 | 65.9 | 72.3 |
| 25 | 149.2 | 135.9 | 138.2 | 144.7 | 72.2 | 77.0 | 63.7 | 66.0 | 72.5 |
| 26 | 149.2 | 136.0 | 138.4 | 144.7 | 72.2 | 77.0 | 63.8 | 66.3 | 72.5 |
| 27 | 149.3 | 136.0 | 138.3 | 144.7 | 72.2 | 77.1 | 63.8 | 66.1 | 72.5 |
| 28 | 149.5 | 136.2 | 138.6 | 145.0 | 72.2 | 77.3 | 64.0 | 66.3 | 72.8 |
| 29 | 149.5 | 136.2 | 138.5 | 145.0 | 72.2 | 77.3 | 64.0 | 66.3 | 72.8 |
| 30 | 149.6 | 136.2 | 138.6 | 145.0 | 72.2 | 77.3 | 64.0 | 66.4 | 72.8 |
| 31 | 149.7 | 136.3 | 138.8 | 145.2 | 72.3 | 77.4 | 64.0 | 66.5 | 72.9 |
| 32 | 149.7 | 136.4 | 138.8 | 145.2 | 72.3 | 77.4 | 64.1 | 66.5 | 72.9 |
| 33 | 149.7 | 136.4 | 138.8 | 145.3 | 72.3 | 77.4 | 64.0 | 66.5 | 73.0 |
| 34 | 149.9 | 136.5 | 138.9 | 145.3 | 72.4 | 77.5 | 64.1 | 66.5 | 73.0 |
| 35 | 149.9 | 136.5 | 138.9 | 145.3 | 72.3 | 77.6 | 64.2 | 66.6 | 73.0 |
| 36 | 149.9 | 136.6 | 139.0 | 145.4 | 72.4 | 77.5 | 64.2 | 66.6 | 73.0 |
| 37 | 150.0 | 136.6 | 139.0 | 145.5 | 72.4 | 77.6 | 64.2 | 66.6 | 73.0 |
| 38 | 150.0 | 136.5 | 139.0 | 145.5 | 72.4 | 77.6 | 64.2 | 66.6 | 73.1 |
| 39 | 150.0 | 136.5 | 139.0 | 145.4 | 72.4 | 77.6 | 64.1 | 66.6 | 73.0 |
| 40 | 150.1 | 136.6 | 139.0 | 145.5 | 72.4 | 77.6 | 64.2 | 66.6 | 73.1 |
| 41 | 150.1 | 136.7 | 139.0 | 145.5 | 72.4 | 77.6 | 64.3 | 66.6 | 73.1 |
| 42 | 150.1 | 136.7 | 139.1 | 145.5 | 72.5 | 77.6 | 64.2 | 66.6 | 73.1 |
| 43 | 150.1 | 136.7 | 139.1 | 145.5 | 72.4 | 77.6 | 64.2 | 66.7 | 73.1 |
| 44 | 150.1 | 136.7 | 139.2 | 145.5 | 72.5 | 77.6 | 64.2 | 66.7 | 73.1 |
| 45 | 150.1 | 136.7 | 139.2 | 145.6 | 72.5 | 77.6 | 64.2 | 66.7 | 73.1 |
| 46 | 150.1 | 136.7 | 139.1 | 145.6 | 72.5 | 77.6 | 64.2 | 66.6 | 73.1 |
| 47 | 150.1 | 136.7 | 139.1 | 145.6 | 72.5 | 77.6 | 64.2 | 66.6 | 73.1 |
| 48 | 150.2 | 136.7 | 139.4 | 145.6 | 72.5 | 77.6 | 64.2 | 66.9 | 73.1 |
| 49 | 150.1 | 136.7 | 139.0 | 145.5 | 72.5 | 77.6 | 64.2 | 66.5 | 73.0 |
| 50 | 150.1 | 136.7 | 139.1 | 145.5 | 72.6 | 77.5 | 64.1 | 66.6 | 73.0 |
| 51 | 150.1 | 136.7 | 139.2 | 145.6 | 72.6 | 77.6 | 64.1 | 66.6 | 73.0 |
| 52 | 150.1 | 136.7 | 139.3 | 145.6 | 72.6 | 77.6 | 64.1 | 66.8 | 73.0 |
| 53 | 150.1 | 136.7 | 139.1 | 145.5 | 72.6 | 77.5 | 64.1 | 66.5 | 72.9 |

This data shows that the average temperature rise at the coils throughout the test was significantly lower for the ventilator with the cooling plate.

Average temperature rise with the cooling plate=57.6 degrees

Average temperature rise without the cooling plate=68.3 degrees

Difference in average temperature rise=10.7 degrees

In addition, the data shows that the maximum temperature rise for each of the windings throughout the test was significantly lower for the ventilator with the cooling plate.

| | W1 Rise | W2 Rise | W3 Rise | W4 Rise |
|---|---|---|---|---|
| Max Temp Rise WITH Cooling Plate | 67.7 | 55.2 | 58.9 | 62.8 |
| Max Temp Rise WITHOUT Cooling Plate | 77.6 | 64.3 | 66.9 | 73.1 |
| Difference in Max Temp Rise | 10.0 | 9.1 | 8.0 | 10.3 |

Average difference in Max Temp Rise=9.3 degrees

Various features and advantages of the invention are set forth in the following claims.

The invention claimed is:

1. A fan assembly comprising:

a drive housing having a shaft opening;

a drive mechanism positioned in the drive housing and including a fan shaft positioned through the shaft opening; and a fan rotor mounted for rotation with the fan shaft, the fan rotor including cooling vanes and a cooling plate positioned between the cooling vanes and the shaft opening, wherein the fan rotor further includes exhaust blades and a back plate between the exhaust blades and the cooling vanes, wherein the cooling plate includes a substantially flat portion adjacent the cooling vanes and a substantially curved portion radially inward of the substantially flat portion to guide air from the drive housing to the cooling vanes, the substantially curved portion being smoothly contoured from adjacent the drive housing to the cooling plate.

2. A fan assembly as claimed in claim 1, wherein the drive mechanism comprises an electric motor.

3. A fan assembly as claimed in claim 1, wherein the cooling plate has a first outer diameter and the back plate has a second outer diameter that is substantially the same as the first outer diameter.

4. A fan assembly as claimed in claim 1, further comprising a main housing having an air inlet shroud guiding air to the exhaust blades, and wherein the fan rotor further includes an inlet venturi plate positioned between the exhaust blades and the air inlet shroud.

5. A fan assembly as claimed in claim 4, wherein the cooling plate has a first outer diameter, the back plate has a second outer diameter that is substantially the same as the first outer diameter, and the inlet venturi plate has a third outer diameter that is substantially the same as the second outer diameter.

6. A fan assembly as claimed in claim 1, wherein the back plate include a series of angle slots, and wherein an end of each cooling vane is positioned in a corresponding angled slot in the back plate.

7. A fan assembly as claimed in claim 6, wherein the cooling plate includes a series of recesses, and wherein the cooling vanes each include a mounting boss positioned in a corresponding recess in the cooling plate.

8. A fan assembly as claimed in claim 1, wherein the cooling plate is mounted for rotation with the cooling vanes.

9. A fan assembly as claimed in claim 1, wherein the cooling plate includes a series of recesses, and wherein the cooling vanes each include a mounting boss positioned in a corresponding recess in the cooling plate.

* * * * *